United States Patent [19]

Williams

[11] 4,154,170

[45] May 15, 1979

[54] RAIL CAR TRANSPORTING AND SHIPPING SYSTEM

[75] Inventor: Harold L. Williams, Latham, Ill.

[73] Assignee: Caterpillar Tractor Co., Peoria, Ill.

[21] Appl. No.: 859,772

[22] Filed: Dec. 12, 1977

[51] Int. Cl.[2] ..... B61B 1/00

[52] U.S. Cl. ..... 104/29; 104/48; 104/122

[58] Field of Search ..... 214/38 CA, 40, 16.1 CE, 214/624; 104/48, 122, 128, 129, 162, 27, 29

[56] References Cited

U.S. PATENT DOCUMENTS

| | | | |
|---|---|---|---|
| 1,716,588 | 6/1929 | Kirchner | 214/38 CA |
| 3,556,011 | 1/1971 | Saxonmeyer | 104/48 |

*Primary Examiner*—Robert G. Sheridan

*Attorney, Agent, or Firm*—Wegner, Stellman, McCord, Wiles & Wood

[57] ABSTRACT

A rail car transporting and shipping system including a shipping floor having an edge, a plurality of elongated pits within the shipping floor and aligned in side-by-side relation and further having open ends at said edge, first railroad rails in each of the pits extending to the edge and adapted to receive a rail car, and a traveling crane movable in a path adjacent the edge and the pit ends. An elongated carriage is mounted on the traveling crane for vertical movement with respect thereto and second railroad rails are disposed on the carriage alignable with the first rails in each of the pits when the carriage is in a lowered position. A hoist is provided for raising and lowering the carriage on the traveling crane and a coupler structure is mounted on the carriage for movement in a direction parallel to the second rails. A drive moves the coupler structure bidirectionally on the carriage whereby a car coupled to the coupler structure may be drawn onto or pushed off of the carriage and a pair of railroad spur lines are spaced from the shipping floor and have ends terminating at a boundary of the traveling crane path, the second rails on the carriage being alignable with the spur lines when the traveling crane is aligned with the corresponding spur line.

13 Claims, 5 Drawing Figures

RAIL CAR TRANSPORTING AND SHIPPING SYSTEM

BACKGROUND OF THE INVENTION

This invention relates to rail car transporting systems and shipping systems employing the same.

Many large manufacturing plants producing products of considerable bulk and/or weight ship from the place of manufacture to a point of distribution and/or use by rail. In a typical installation, there will be an elongated shipping floor which receives the manufactured products preparatory to their being placed on rail cars. Typically, the shipping floor is flanked or bifurcated by one or more railroad spurs each capable of receiving a plurality of rail cars which are coupled together in a conventional fashion. At the beginning of a shipping cycle, a series of the rail cars is disposed on the spur adjacent the shipping floor and the loading process initiated.

In many instances, the loading of each rail car will progress at a different pace for any of a variety of reasons. For example, when different products are being shipped from the same place of manufacture at different points on the shipping floor, one product may take more time to load than another. For example, a motor grader may typically be driven directly onto a rail car and suitably blocked in place while a motorized scraper may, in part, require hoisting into place on a rail car prior to being blocked. Other large vehicles, fully assembled for testing purposes prior to shipping, may require partial disassembly at the shipping floor prior to being disposed on a rail car. Consequently, when a variety of products, such as those mentioned, are being shipped simultaneously from the same shipping floor at different points thereon, products such as motor graders can be loaded in considerably less time than other products which require partial disassembly prior to loading or hoisting in place.

This, in turn, results in inefficiency in the shipping operation. For once the rail cars at, for example, the point on the shipping floor whereat motor graders are loaded, are fully loaded and blocked, further activity must cease until such time as other rail cars receiving scrapers or other heavy equipment requiring partial disassembly are loaded. This inefficiency is occasioned by the fact that the rail cars are disposed adjacent the shipping floor in a serial fashion and it is uneconomical to remove anything less than the entire string of rail cars disposed on the spur adjacent the shipping floor.

The problem is compounded by fluctuation in railroad schedules. If a railroad locomotive appears prior to the completion of loading of all cars in the string, because the railroad typically is a separate entity from the manufacturing plant, it may be necessary to remove a partially loaded string of cars in order to ensure that those components already loaded are shipped in a timely fashion. When this occurs, loading at the stations adjacent the unused cars must cease until such time as a new string of empty cars is placed on the spur.

Conversely, if the railroad locomotive appears at a time later than scheduled, all activity on the shipping floor must cease since there will be no cars available to receive products to be shipped, all cars at the loading floor already being fully loaded.

Still another factor inhibiting efficiency of such a system is the fact that rail cars as, for example, flat cars, frequently have their load receiving surfaces in various states of disrepair. Where a car having a poorer than average load receiving surface is disposed at a location along the shipping floor to receive a relatively light load, no impediment may exist. However, if the same car is disposed at a station to receive a relatively heavy load, prior to its being loaded, it may be necessary to effect minor repair of the rail car prior to loading which, of course, is time-consuming and contributes to the problems mentioned previously. Should the rail car be in a state of major disrepair, it may be unusable to receive a load of any type with the consequence that it must remain unloaded thereby bringing to a complete halt, any loading activity at the station on the shipping floor whereat it is located.

As a result of the foregoing problems, a manufacturing plant typically may have difficulty meeting shipping schedules and/or may require overly large shipping and repair crews at excessive cost and/or may have to shuffle members of a shipping crew to a repair crew or vice versa any and all of which are inefficient, time-consuming and costly.

SUMMARY OF THE INVENTION

The present invention is directed to overcoming one or more of the above problems.

According to one aspect of the invention, there is provided a shipping system including a loading dock. An elongated pit is adjacent the dock and has an open end. Railroad rails are disposed within the pit for receiving a rail car so that the car may be loaded from the dock. A traveling crane is mounted for movement in a path adjacent and across the open end of the pit and an elongated carriage is mounted on the crane. Means are provided for raising and lowering the carriage on the crane and railroad rails are disposed on the carriage and are alignable with the rails in the pit and also adapted to receive a rail car. A traveling coupler structure is located on the crane and is movable in a direction parallel to the carriage rails and there are provided means for moving the coupler structure on the carriage whereby a rail car may be drawn onto a pushed off of the carriage when coupled to the coupler structure.

According to another aspect of the invention, there is provided a rail car transporting system including a plurality of elongated pits aligned in side-by-side relation. Railroad rails are disposed in the pits and extend to at least one end of each and a traveling crane is movable in a path over each of the pits. An elongated carriage is mounted on the crane for vertical movement with respect thereto into and out of alignment with each of the pits and railroad rails are disposed on the carriage and are alignable with the rails in each pit when the carriage is aligned with the corresponding pit. Means are provided for raising and lowering the carriage.

Other objects and advantages will become apparent from the following specification taken in connection with the accompanying drawings.

DESCRIPTION OF THE PREFERRED EMBODIMENT

Figure 1:
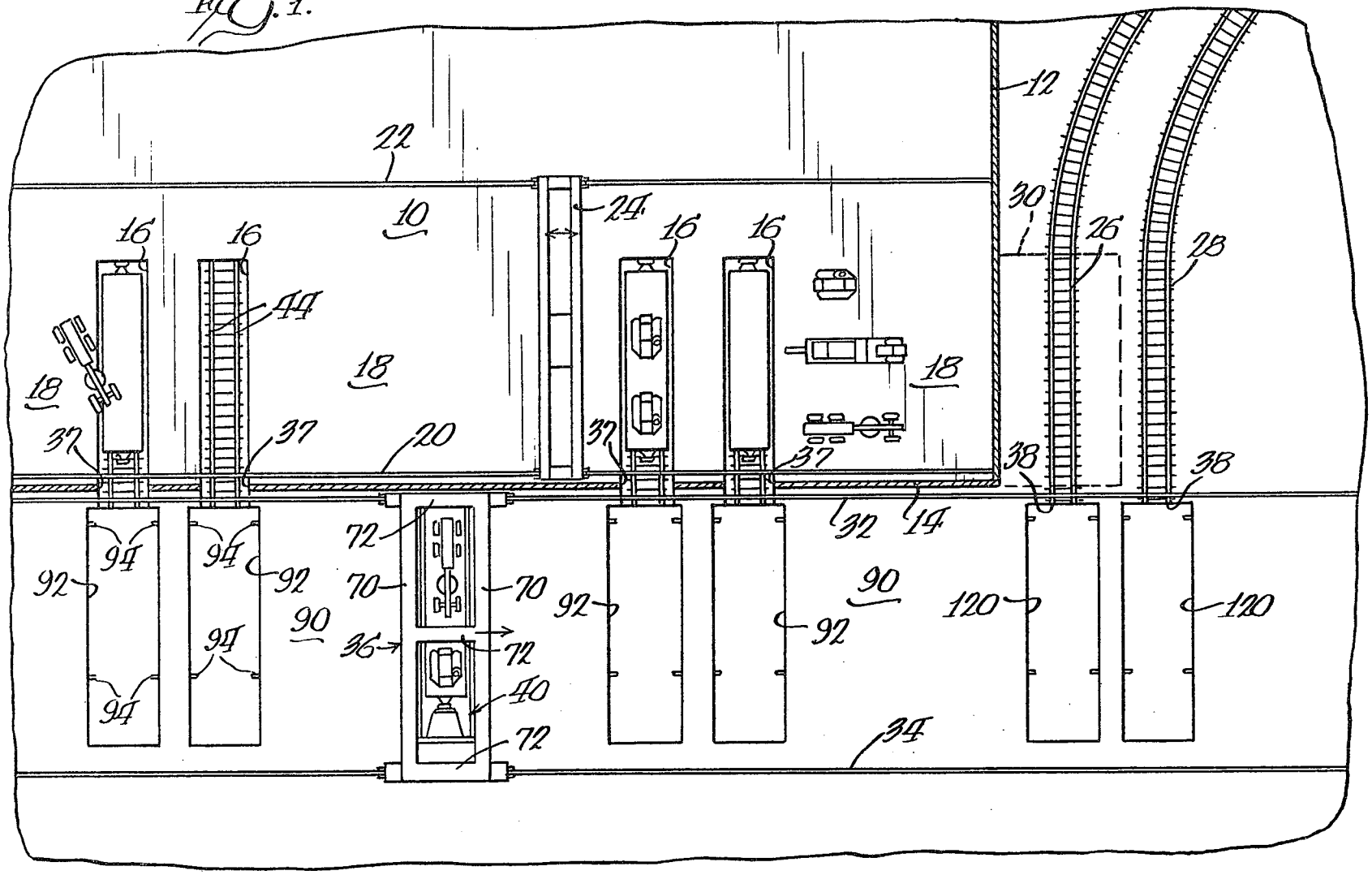
FIG. 1 is a plan view of a shipping system embodying a rail car transporting system made according to the invention.

An exemplary embodiment of a shipping system embodying a rail car transporting system made according to the invention is illustrated in FIG. 1 and includes a shipping floor 10 housed within a building having exterior walls 12 and 14. The building is useful as offering weather protection for the shipping floor 10 but it is to be understood that where such is not a concern, the building may be dispensed with.

Within the shipping floor 10 are a plurality of pits 16 which, in effect, divide the shipping floor 10 into a plurality of loading areas or docks 18. The pits 16 are aligned in side-by-side relationship and are spaced. As illustrated in FIG. 1, the pits 16 are paired but, again, it is to be understood, that pairing of the pits 16 is not an essential element of the invention.

An elongated, elevated rail 20 is supported in any suitable fashion adjacent the exterior wall 14 on the interior of the building and a parallel rail 22, also within the building is spaced therefrom beyond the edges of the pits 16. A traveling hoist 24 of conventional construction is supported by the rails 20 and 22 for movement over the shipping floor 10 and may be used for hoisting products to be shipped onto rail cars received within the pits 16, as will be described, or for disassembling parts of large products which are to be loaded prior to loading.

Adjacent the wall 12 is a pair of railroad spurs 26 and 28, although greater or lesser numbers of spurs may be used as will become apparent hereinafter. Typically, the spur 26 is provided with unloaded rail cars which, by means to be seen, may be disposed in any one of the pits 16 while the spur 28 receives loaded cars removed from any of the pits 16 after they have been loaded at the shipping floor 10.

It is preferred, although not necessary, that the spur 26 receiving unloaded cars be located most nearly adjacent the wall 12 so that the wall 12 may partially support a roof or an enclosure, shown schematically at 30, covering part of the spur 26. Such an enclosure 30, if used, may house heaters for melting accumulated ice or snow from the rail cars prior to their use and/or provide a protected repair area whereat repairs to the load receiving surfaces of the rail cars may be performed well away from the shipping floor 10 so as to not obstruct shipping operations.

Within the enclosure 30, an inspection may be made of incoming empty rail cars to determine whether any are beyond repair prior to their being moving to the shipping area 10 so that they may be immediately transferred to the outgoing spur 28, bypassing the shipping area 10 entirely.

Extending along the exterior wall 14 of the building and beyond the spurs 26 and 28 is an elongated rail 32 which is elevated and which may be supported in any suitable fashion in close proximity to the wall 14. A ground level rail 34 is parallel to the rail 32 and spaced from the exterior wall 14. The rails 32 and 34 serve to guide a traveling crane, generally designated 36, for movement in a path adjacent the wall 14, open ends 37 of the pits 16 and the ends 38 of the spurs 26 and 28. Through suitable controls forming no part of the invention as, for example, photoelectric sensors, the traveling crane 36 may be stopped in its path of movement in alignment with any of the pits 16 or with either of the spurs 26 and 28.

Figure 4:
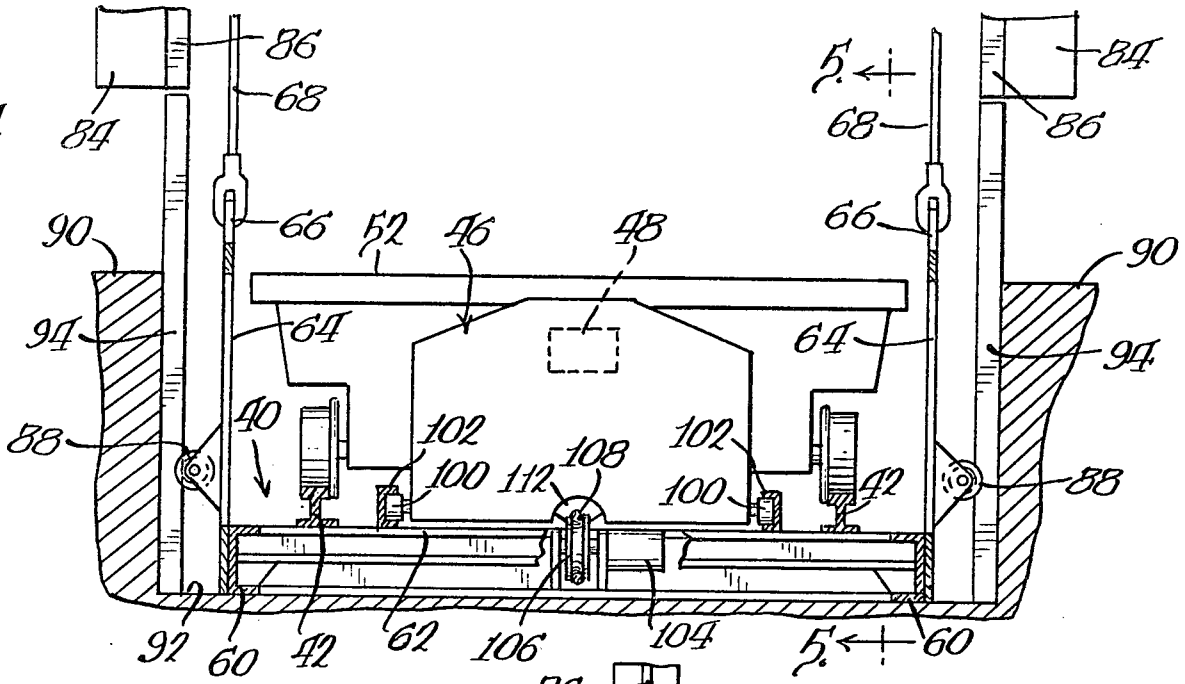
FIG. 4 is an enlarged, sectional view taken approximately along the line 4—4 of FIG. 3.
Figure 5:
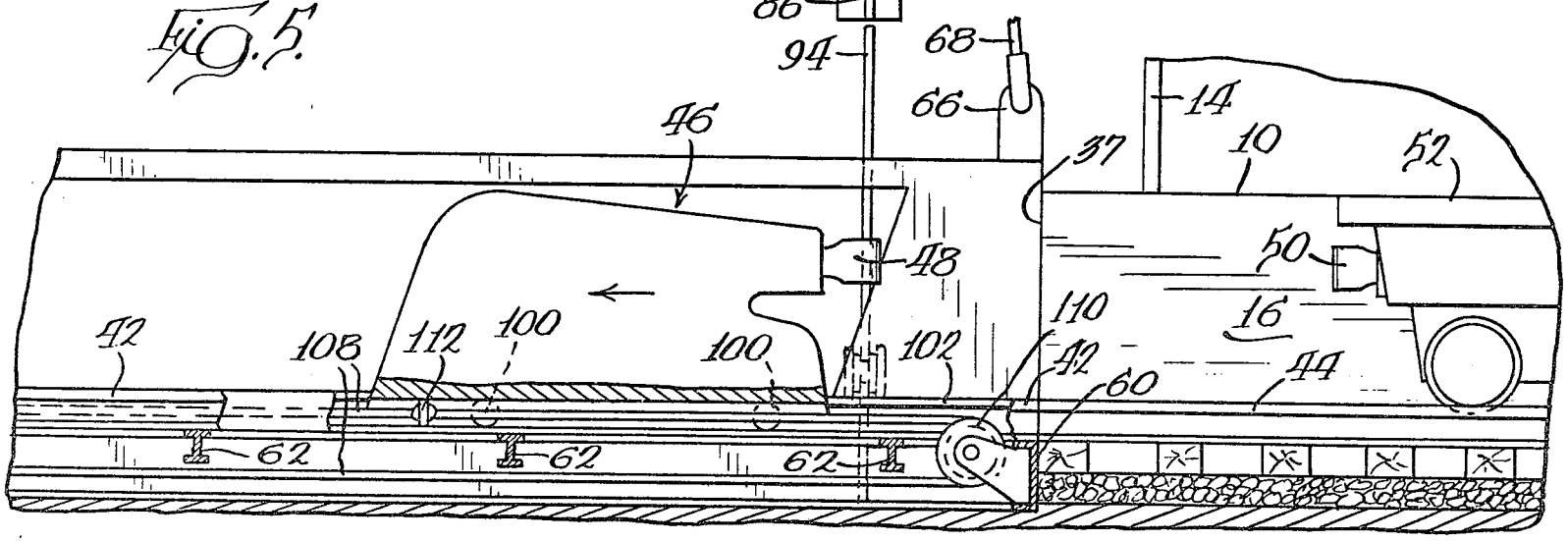
FIG. 5 is an enlarged, sectional view taken approximately along the line 5—5 in FIG. 4.

An elongated carriage, generally designated 40, is carried by the crane 36 and is mounted thereon for substantially vertical movement whereby the same may be raised or lowered. As best seen in FIGS. 4 and 5, the carriage 40 mounts railroad rails 42 which may receive a rail car and which may be aligned with rails 44 in each of the pits 16 which also may receive a rail car. The rails 42 on the carriage may also align with the rails comprising the rail spurs 26 or 28.

A traveling coupler structure, generally designated 46, is mounted for movement on the carriage 40 in a direction parallel to the rails 42 and, as seen in FIGS. 4 and 5, mounts a conventional railroad type knuckle coupler 48 which may be coupled to a coupler 50 on a rail car 52. Means, to be described, move the coupler structure 46 within the carriage 40, bidirectionally, so that the same, when the traveling crane 36 is aligned with the spur 26, may be coupled to an empty rail car thereon and draw the same onto the carriage 40. The coupler structure 46 may also be coupled to a rail car within any one of the pits 16 and draw the same onto the carriage 40.

At the same time, the coupler structure 46 may be operated to push a rail car off of the carriage 40 onto the rails 44 in any of the pits 16 or onto the spur 28.

Before proceeding further with a detailed description of certain of the components described generally thus far, the advantages of the system over those used according to prior art teachings will be discussed.

Initially, the system provides a means whereby unusable rail cars may bypass the shipping area entirely. If a rail car is determined to be unusable, the crane 36 may be employed to shift the same directly from the spur 26 to the spur 28 through suitable operation of the carriage 40 and the coupler structure 36, as generally described previously.

The system also avoids the necessity of effecting minor repair to the rail cars at the shipping floor since such repairs can be performed in the enclosure 30 or at a similar area. Consequently, loading of a car at the shipping floor 10 may proceed as soon as one of the cars is disposed in the pit 16 without waiting for repairs to be made thereat.

Where a variety of products, each having a different loading time are to be shipped, holdups at the shipping station whereat the short loading time products are loaded are eliminated since, as soon as a car is loaded at such a station, it may be retrieved by the crane 36 and removed to the outgoing spur 28. An empty car may then be picked up from the spur 26 and brought immediately to the now empty pit 16 so as to enable the next loading operation to proceed. In this connection, it is desirable that the low loading time products be shipped from that part of the shipping floor 10 in closest proximity to the spurs 26 and 28 so as to minimize waiting time accompanying movement of the crane 36 from a given pit 16 to the spurs 26 and 28 as well as the return trip.

It will also be appreciated that dependence upon railroad schedules and resulting inefficiencies are eliminated since the movement of rail cars into and out of the shipping floor 10 is controlled by the manufacturer through operation of the crane 36 rather than by the railroad.

Figure 2:
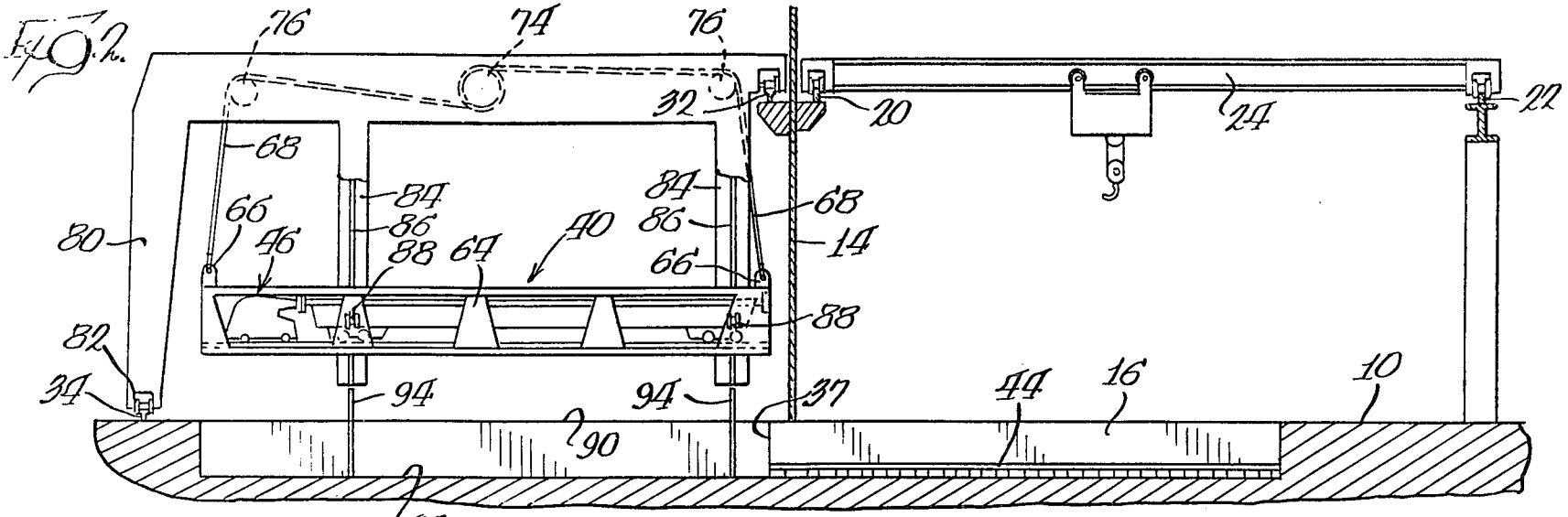
FIG. 2 is an enlarged, fragmentary, elevational view illustrating a rail car in the process of being transported.
Figure 3:
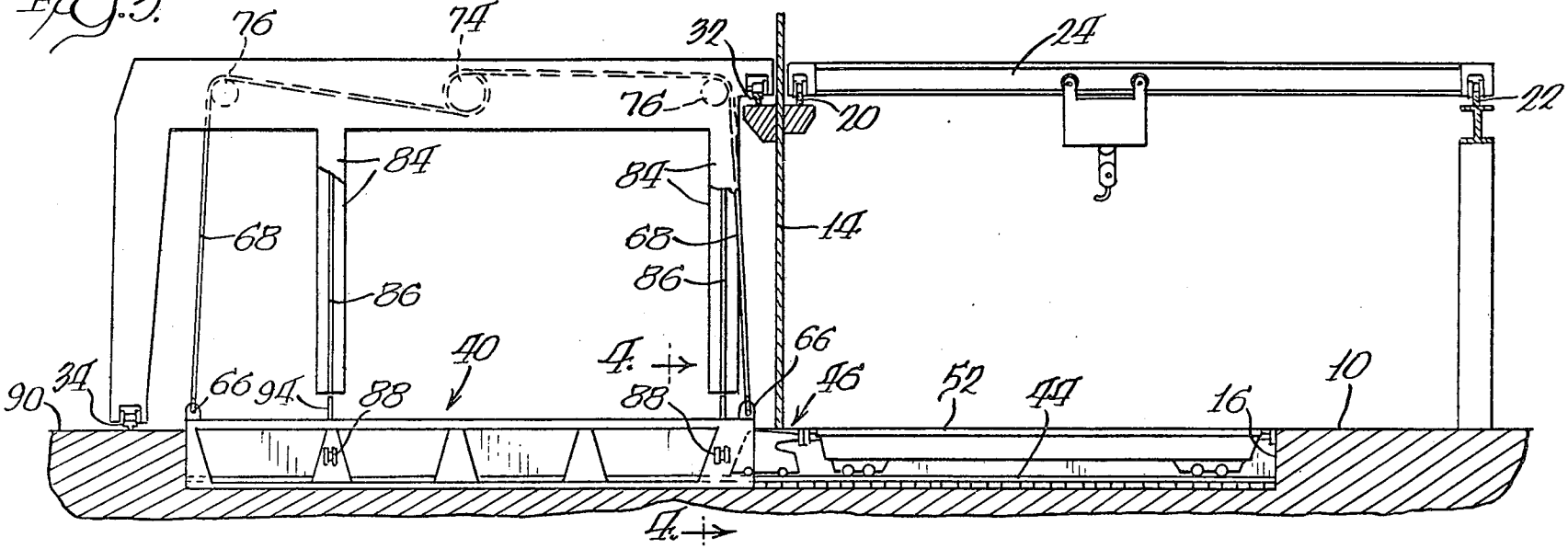
FIG. 3 is a view similar to FIG. 2, but illustrating the rail car disposed in a pit adjacent a shipping floor.

According to one embodiment of the invention, the carriage 40 includes a base 60 formed of interconnected channels or the like with cross members 62 serving as ties for mounting the railroad tracks 42. As best seen in FIGS. 2 and 3, the channels 60 mount any suitable type of side member 64 which may be formed of suitably interconnected beams and which are provided with eyes 66 near their uppermost ends. Four of the eyes 66 are utilized, one at each corner of the carriage 40 and each has a cable 68 connected thereto.

The crane 36 includes an overhead support structure defined by spaced, longitudinally extending beams 70 suitably interconnected by cross members 72, as seen in FIG. 1. As seen in FIG. 2, a suitably powered winch drum 74 is journalled by the support structure and at opposite ends thereof are four sheaves 76, one for each cable 68. The cables are fastened to the drum 74 and when the same is rotated, equal lengths of each of the cables 68 will be pulled onto the drum 74 or payed out therefrom resulting in the raising or lowering, respectively, of the carriage 40 relative to the traveling crane 36.

The winch 74 may be conventional and conventionally controlled.

Depending from the overhead support structure is a pair of spaced legs 80 provided with rollers 82 which engage the ground level track 34. The rollers 82 may be driven to propel the crane 36 in its path of movement to and from the various stations mentioned previously. Also depending from the support structure are a plurality of guide legs 84. In the illustrated embodiment, four of the guide legs 84 are utilized, two being on each side of the carriage 40 and near opposite ends thereof.

Each guide leg 84 includes an inwardly directed rail 86 which is adapted to be engaged by a corresponding grooved roller 88 mounted on the sides 64 of the carriage 40. The rollers 88 are grooved so as to act as thrust rollers, preventing end-to-end swaying of the carriage 40. And, by reason of the fact that the rails 86 flank opposite sides of the carriage 40, the carriage is guided for vertical movement and prevented from swaying from side to side. Thus, through a relatively simple, and easily serviceable cable system, notwithstanding the high loads encountered with loaded rail cars, smooth raising and lowering of the carriage 40 is attained without danger of the same tipping, such that the rail car would tend to leave the same under the influence of gravity.

In the disclosed embodiment, there is located a receiving area 90 along the exterior wall 14 and below the path of travel of the crane 36. Incoming materials may be received at the area 90 and shifted to the interior of the building through suitable doors, not shown. To facilitate such a transfer, the surface of the receiving area 90 may be in the same plane as that of the shipping floor 10, as best seen in FIG. 2. Accordingly, in order to allow alignment of the rails 42 on the carriage with the rails 44 within each of the pits 16, the receiving area 90 is provided with a series of pits 92 into which the carriage 40 may be lowered, as illustrated in FIG. 3. When such exterior pits 92 are utilized, the side walls thereof are provided with vertically extending guide rails 94, as seen in the various Figures.

As best seen in FIG. 4, the guide rails 94 are aligned with the guide rails 86 when the traveling crane 36 is properly aligned with the corresponding pit 16 and, it will further be appreciated that the guide rails 94 extend upwardly to a point just short of the lowermost extent of the guide legs 84 on the traveling crane 36.

In a preferred embodiment, the coupler structure 46, adjacent its lower extremity, mounts rollers 100 which are received in rails 102 configured as channels having their open sides facing each other so as to capture the rollers 100 and yet guide the coupler structure for the movement mentioned previously. Thus, jarring contact between a rail car 52 and the coupler structure 46 cannot dislodge the coupler structure 46.

To provide motive power for moving the coupler structure 46, a motor 104 is suitably mounted in the base of the carriage 40, near one end thereof, and drives a sheave 106 (FIG. 4). A cable 108 is trained about the sheave 106 as well as about an idler sheave 110 (FIG. 5) at the opposite end of the carriage 40. The upper run of the cable 108 is secured as at 112 (FIG. 5) to the coupler structure 46 near the end thereof remote from the coupler 48. By suitably operating the motor 104, the coupler structure 46 may be withdrawn fully onto the carriage, as shown in FIG. 2, or may be moved to a point partially off of the carriage, as illustrated in FIG. 3, to partially enter an aligned pit 16 to ensure that a rail car will not partially overhang the edge of the carriage 40 to be snagged thereby when the carriage 40 is elevated.

Since the carriage rails 42 are supported on the base of the carriage defined by means 60 and 62, and such structure necessarily required that the rails 42 be above grade when the carriage is at its lowermost position, in order to provide for alignment of the rails 42 with the spurs 26 and 28, relatively shallow pits 120 are aligned with each of the ends 38.

While not shown herein, it is contemplated that a number of interlocks be provided in the control system for the various components. For example, a suitable interlock would be provided in the motive circuit for causing the traveling crane 36 to move in its path along the building exterior 14 that would allow such travel only when the carriage 40 is in its fully uppermost position. Similarly, an interlock would be provided for the winch 74 to prevent lowering of the carriage 40 except when other sensors have determined that the crane 36 is properly aligned with one of the pits 16 or with one of the spurs 26 and 28. A further interlock would be provided to prevent movement of the coupler structure 46 except when the carriage 40 is fully settled into one of the pits 92 or 120 and still a further interlock would be provided to prevent raising of the carriage 40 except when the coupler structure 46 is retracted to a position clear of the end of the carriage when not coupled to a rail car or fully retracted to a position shown when coupled to a rail car.

From the foregoing, it will be appreciated that a rail car transporting system made according to the invention enables positive and rapid shifting of rail cars from one location to another without requiring movement of a plurality of cars. It will also be recognized that the transporting system can be used with great advantage in a shipping system according to the invention which eliminates the considerable inefficiency presently associated with typical shipping facilities.

The embodiments of the invention in which an exclusive property or privilege is claimed are defined as follows:

1. A shipping system comprising:

a loading dock;

an elongated pit adjacent said dock and having an open end;

railroad rails within said pit for receiving a rail car so that the car may be loaded from said dock;

a traveling crane mounted for movement in a path adjacent and across said open end;

an elongated carriage mounted on said crane;
means for raising and lowering said carriage on said crane;
railroad rails on said carriage alignable with said pit rails and adapted to receive a rail car;
a traveling coupler structure on said carriage movable in a direction parallel to said carriage rails; and
means for moving said coupler structure in said direction whereby a rail car may be drawn onto a pushed off of said carriage.

2. The shipping system of claim 1 wherein said loading dock is a shipping floor, there being a plurality of said pits in said floor in spaced relation to each other, each of said pits having railroad rails therein, said system further including a pair of railroad spur lines having ends, said crane path extending adjacent to and across the open ends of each of said pits and the ends of said spur lines.

3. The shipping system of claim 1 further including guide means on said carriage and engaged with said coupler structure for guiding said coupler structure for movement in said direction and for retaining said coupler structure on said carriage.

4. The shipping system of claim 1 wherein said crane includes an overhead support structure, a plurality of legs depending from said support structure and flanking said carriage in close proximity to opposite sides thereof, and rollers on the sides of said carriage engaging corresponding ones of said legs, at least one of said rollers being a thrust roller to eliminate end to end relative movement between said crane and said carriage.

5. The shipping system of claim 4 wherein said raising said lowering means comprises a cable winch on said support structure and having at least four cables connected to said carriage, two on each side thereof and two near each end thereof.

6. The shipping system of claim 4 further including an additional pit aligned with said first-named pit and adjoining the same, said additional pit being located in said path and adapted to receive said carriage; and vertically extending guides in said additional pit located to be aligned with said legs when said crane overlies said additional pit and to engage said rollers when said carriage is received in said additional pit.

7. A rail car transporting system, comprising:
a plurality of elongated pits aligned in side-by-side relation;
first railroad rails extending to at least one end of each said pit;
a traveling crane movable in a path over each of said pits;
an elongated carriage mounted on said crane for vertical movement with respect thereto into or out of each said pit;
second railroad rails on said carriage alignable with said first rails in each pit when said carriage is in the corresponding pit;
guide means guiding said carriage during said vertical movement for causing said first and second rails to align; and
means for raising and lowering said carriage.

8. The rail car transporting system of claim 7 further including a coupler structure mounted for movement on said carriage generally parallel to said second rails and adapted to be coupled to a rail car; and powered means for bidirectionally moving said coupler structure on said carriage.

9. A shipping system, comprising:
a building housing a shipping floor and having an exterior wall;
an overhead loading crane within said building mounted for movement over said shipping floor;
a plurality of elongated pits within said building in said shipping floor and aligned in side-by-side relation, said pits having open ends accessible from the exterior of said building through said exterior wall;
first railroad rails in each of said pits extending to said exterior wall and adapted to receive a rail car;
a traveling crane on the exterior of said building and movable in a path adjacent said exterior wall and said pit ends;
an elongated carriage mounted on said traveling crane for vertical movement with respect thereto;
second railroad rails on said carriage alignable with said first rails in each said pit when said carriage is in a lowered position and when said traveling crane is aligned with the corresponding pit;
means for raising and lowering said carriage on said traveling crane;
a coupler structure mounted on said carriage for movement in a direction parallel to said second rails;
means for moving said coupler structure in said direction whereby a rail car coupled to said coupler structure may be drawn onto or pushed off of said carriage; and
a pair of railroad spur lines exterior of said building and having ends terminating at a boundary of said traveling crane path, said second rails being alignable with said spur lines when said traveling crane is aligned with the corresponding spur line.

10. The shipping system of claim 9 wherein said first rails and said spur lines terminate on a common edge of said path.

11. A shipping system, comprising:
a shipping floor having an edge;
a plurality of elongated pits in said shipping floor and aligned in side-by-side relation, said pits having open ends at said edge;
first railroad rails in each of said pits extending to said edge and adapted to receive a rail car;
a traveling crane movable in a path adjacent said edge and said pit ends;
an elongated carriage mounted on said traveling crane for vertical movement with respect thereto;
second railroad rails on said carriage alignable with said first rails in each said pit when said carriage is in a lowered position and when said traveling crane is aligned with the corresponding pit;
means for raising and lowering said carriage on said traveling crane;
a coupler structure mounted on said carriage for movement in a direction parallel to said second rails;
means for moving said coupler structure in said direction whereby a rail car coupled to said coupler structure may be drawn onto or pushed off of said carriage; and
at least one railroad spur line spaced from said shipping floor and having an end terminating at a boundary of said traveling crane path, said second rails being alignable with said spur line when said traveling crane is aligned with the spur line.

12. A shipping system comprising:
a loading dock;

side by side elongated pits adjacent said dock and each having an open end;

railroad rails within said pits for receiving rail cars so that a car may be loaded from said dock;

an elongated carriage;

carriage moving means for moving said carriage in a path into alignment with the open ends of said pits;

railroad rails on said carriage alignable with said pit rails and adapted to receive a rail car;

rail car moving means for moving a rail car onto or off of said carriage; and at least one railroad spur line having an end, said carriage path extending to the end of said spur line.

13. The shipping system of claim 12 wherein said rail car moving means comprises a travelling coupler structure mounted on said carriage.

* * * * *